United States Patent [19]

Petrovic et al.

[11] Patent Number: 4,481,724

[45] Date of Patent: Nov. 13, 1984

[54] DEVICE FOR DRYING AND PREHEATING COKING COAL

[75] Inventors: Vladan Petrovic; Heinz Dürselen, both of Essen, Fed. Rep. of Germany

[73] Assignee: Krupp-Koppers GmbH, Essen, Fed. Rep. of Germany

[21] Appl. No.: 370,124

[22] Filed: Apr. 20, 1982

[30] Foreign Application Priority Data

May 7, 1981 [DE] Fed. Rep. of Germany ..... 3117967

[51] Int. Cl.[3] ..... F26B 17/14

[52] U.S. Cl. ..... 34/168; 34/177; 34/211; 165/144; 432/102

[58] Field of Search ..... 432/102; 165/143, 144, 165/145, 109 R; 34/168, 177, 57 A, 57 R, 211

[56] References Cited

U.S. PATENT DOCUMENTS 2,351,875 6/1944 Payne ..... 34/177

2,549,104 4/1951 Lechthaler ..... 34/177

2,941,310 6/1960 Schaub ..... 34/177

4,096,642 6/1978 Triebel ..... 34/57 R

*Primary Examiner*—Larry I. Schwartz

*Attorney, Agent, or Firm*—Michael J. Striker

[57] ABSTRACT

In order to preserve the quality of treated coking coal, the drying and preheating operation is performed in consecutive stages. For this purpose, a set of superimposed containers is provided with vertically oriented pipes for a heating medium, the pipes in each container having separate inlets and outlets. The bottom region of each container is further provided with horizontally directed pipes having separate inlet and outlet for receiving a pressure medium which is discharged into the bottom region of each container to produce a whirling bed of the coal. In this manner, the coal is preliminarily dried in the uppermost container, then additionally dried and preheated in the intermediate container, and heated to the desired final temperature in the lowermost container.

2 Claims, 5 Drawing Figures

DEVICE FOR DRYING AND PREHEATING COKING COAL

BACKGROUND OF THE INVENTION

The present invention relates in general to a device for handling coking coal, and in particular to a device for drying and preheating coking coal in a turbulent layer by means of an indirect heat exchange with a heating medium.

A device of this kind is known from German patent publication No. 2 342 184, in which steam is employed both as heating medium and as a medium for producing a fluidized bed of the coal. The drying and the preheating of the coal to a temperature above 150° C. in this prior-art device is made in a single stage. As a consequence, a very intensive heat supply is necessary. It has been found, however, that such an excessive exposure to heat is disadvantageous for the condition of the treated coal. For example, in this prior-art device coal is prone to cake together or to bake on the heating pipes. In addition, local overheating of coal particles may occur, resulting in undesirable changes of the coking quality of the coal.

SUMMARY OF THE INVENTION

It is therefore a general object of the present invention to overcome the aforementioned disadvantages.

More particularly, it is an object of the invention to provide an improved device of the aforedescribed type which ensures a flawless treatment of the coking coal.

In keeping with this object, and others which will become apparent hereafter, one feature of the invention resides, in a device for drying and preheating coking coal, in the provision of a plurality of superposed containers interconnected in cascade for passing downwardly the coal to be treated, each of the containers housing at least one array of vertically oriented heating pipes, and each container defining a bottom region provided with means for imparting a turbulent flow to the coal.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
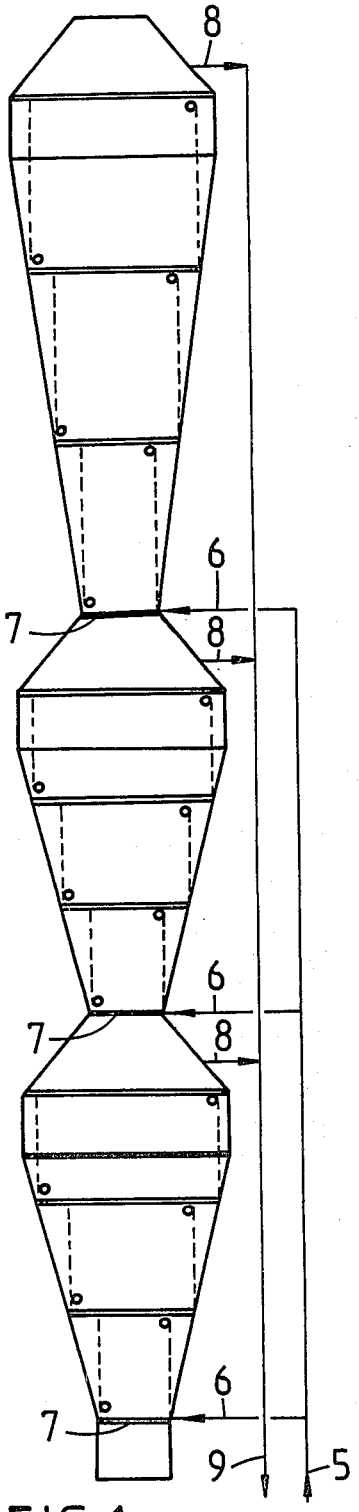
FIGS. 1 and 2 show respectively a side view and a front view of the device of this invention.
Figure 2:
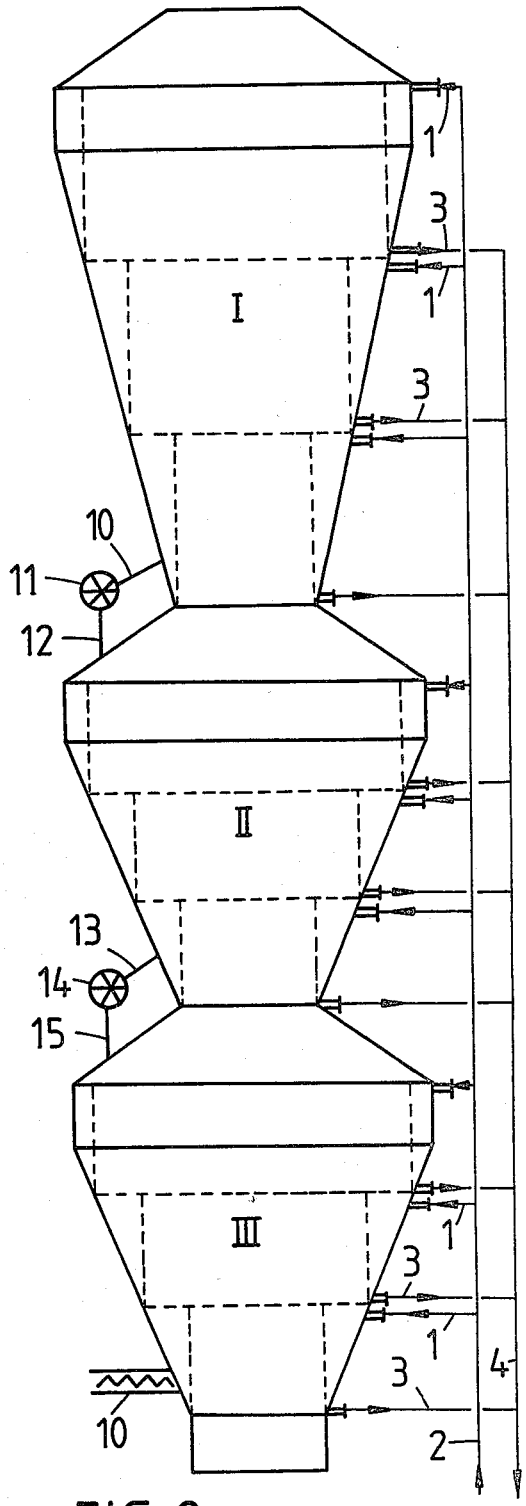
Figure 3:
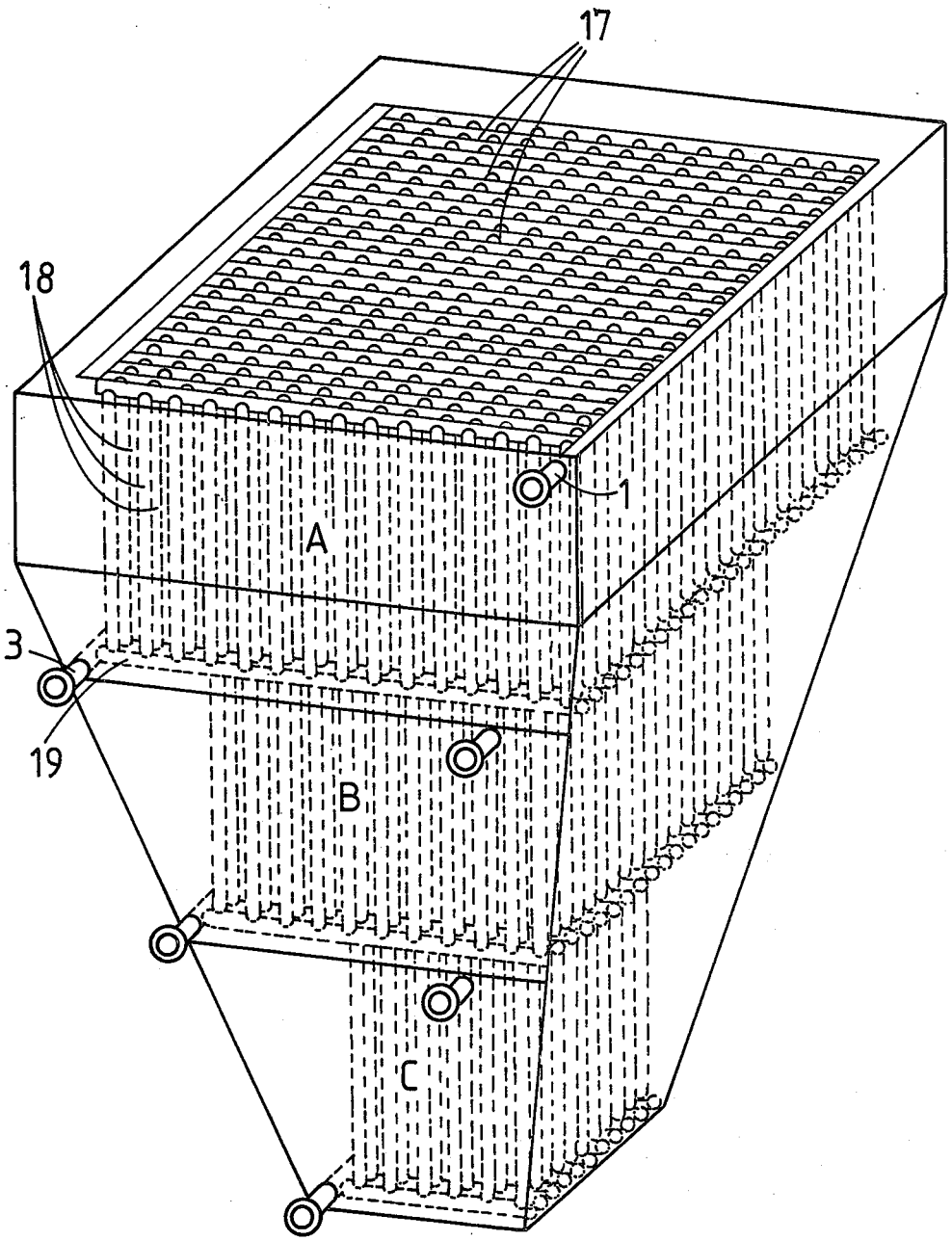
FIG. 3 shows on an enlarged scale a perspective view of one stage of the device of FIGS. 1 and 2.

Referring firstly to FIGS. 1 and 2, it will be seen that the device for drying and preheating coking coal is assembled of three superposed containers I, II and III interconnected in cascade. Each of the containers has a top region in the form of a truncated pyramid, a center region in the form of a rectangular prism, and a bottom region in the form of a reciprocal truncated pyramid with downwardly converging walls. As seen in FIG. 3, each of the containers houses three superimposed pipe arrays A, B and C. These arrays of vertically oriented heating pipes are connected respectively by means of connection pieces 1 to a main supply conduit 2 for a heating medium, and by means of a connection piece 3 to main return conduit for the heating medium. The heating medium can be constituted by various gaseous heat carriers such as steam, for instance saturated steam of 20 bar. For producing turbulent layers in the stream of coal passing through the truncated containers, the bottom region 7 of each container is connected through a connection piece 6 to a conduit 5 through which a jet of steam is applied into the bottom region 7 as will be described in greater detail below. The discharge of this medium for producing the whirling bed is effected through connection pieces 8 and the return conduit 9. In this embodiment, the individual containers 1, 2 and 3 are hermetically separated one from the other. In a modification, the containers are interconnected and the turbulent layer is produced at the bottom 7 of the lowermost container III. In the latter embodiment, the medium for producing the whirling bed flows through the lowermost container and reaches through the open bottom regions 7 the intermediate and the uppermost containers II and I and is discharged into the return conduit 9 at the top region of the container I. In this modification, the aforementioned gas-tight separation of individual containers is avoided.

Coal to be treated is first charged into the uppermost container 1 and after passing through the respective regions it is discharged through duct 10, which communicates with the bottom region of the container I. The duct 10 is connected by means of a bucket-wheel sluiceway 11 and a duct 12 to the top region of the intermediate container II, and in the same manner it is discharged from the latter through duct 13, bucket wheel sluiceway 14 and the duct 15 in the top region of the lowermost container III, from which it is discharged by means of a screw conveyor 10 opening into the bottom region of container 3. In passing the three stages of the cascade-connected containers, the treated coal undergoes a stepwise heat treatment. In the uppermost container, the coal undergoes a preliminary drying, whereas in the intermediate container the drying and preheating of the coal takes place. In the lowermost container the coal is heated to the desired final temperature. By virtue of this stepwise heat treatment the desired condition of the coal is preserved during the whole operational cycle.

FIG. 3 illustrates the arrangement of arrays A, B, C of vertically oriented heating pipes arranged one above the other in each of the containers. Each array is supplied with heating fluid passing through connection pieces 1 and returned through connection pieces 3 at each of the arrays. Both the intake connection pieces and the return connection pieces communicate with horizontally oriented distributing conduits 17 which in turn communicate with the vertically directed heating pipes 18. The lower ends of the arrayed heating pipes communicate with horizontally directed collecting conduits 19 which are connected through the connection pipe 3 with the aforementioned main return conduit 4. The vertical orientation of heating pipes is of particular advantage when saturated steam is employed as heating medium, since in this case a uniform condensation of saturated steam is ensured.

Figure 4:
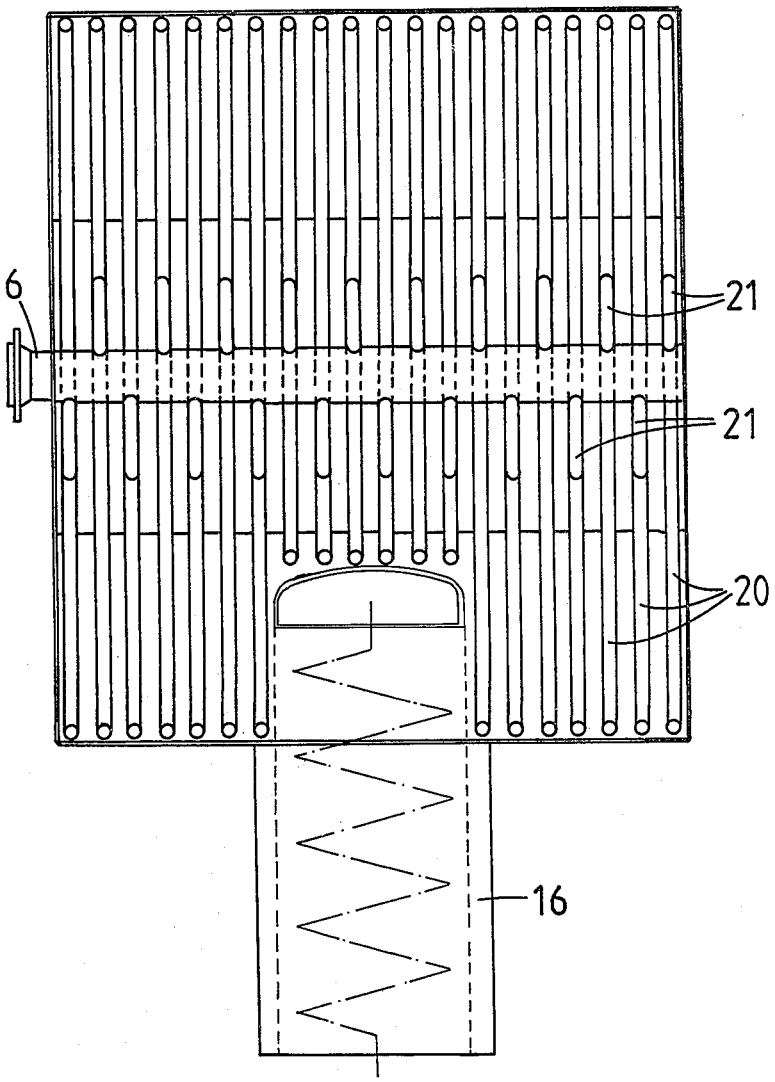
FIG. 4 shows a plan view of the bottom region of a stage in the device in FIGS. 1 and 2.
Figure 5:
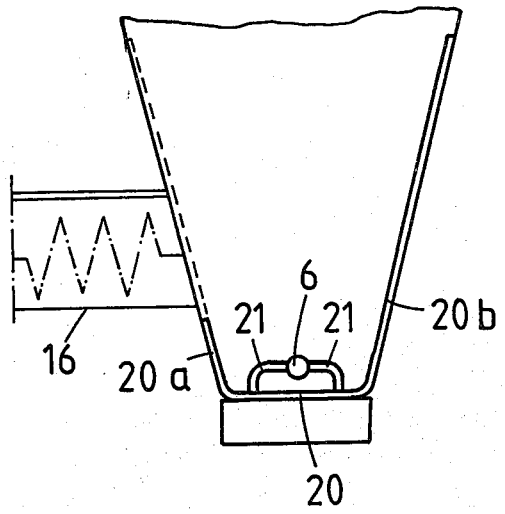
FIG. 5 is a side view of the bottom region of FIG. 4.

The means for imparting a turbulent movement to the coal stream in the bottom region of each container can be of different construction. In the preferred embodiment shown in FIGS. 4 and 5, the bottom region comprises a number of horizontally directed pipes 20 arranged side-by-side and communicating with the intake pipe 6 for the whirling medium and being provided with discharge openings for the latter. These discharge openings are formed preferably on the bottom sides of respective horizontal pipes 20 and have a diameter of 5 mm, for example. By this means it is achieved that, in case of an interruption of supply of the whirling medium, no coal particles can clog the discharge openings. The horizontal pipes 20 are connected to the connection pipe 6 by means of a plurality of branch conduits 21. As seen more clearly in FIG. 5, the horizontal pipes 20 are bent upwardly into a V-shaped configuration defining arms 20*a* and 20*b* extending along the inner wall of the bottom region of each container. Also, these upwardly directed arms 20*a* and 20*b* are provided with discharge openings for the whirling medium, thus causing an additional turbulent movement of the coal along the walls of the container.

It will be understood that each of the elements described above, or two or more together, may also find a useful application in other types of constructions differing from the types described above.

While the invention has been illustrated and described as embodied in a specific example of the cascaded drying and preheating device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential features of the generic or specific aspects of this invention.

What is claimed as new and desired to be protected by Letters Patent is set forth in the appended claims:

1. A device for drying and preheating coking coal in a turbulent layer by means of an indirect heat exchange with a heating medium, comprising a plurality of superposed containers interconnected in cascade for passing downwardly the coal to be treated; each of said containers housing at least one array of vertically oriented heating pipes; each container defining a bottom region provided with means for imparting a turbulent flow to the coal; each of said containers defining a bottom region with a downwardly converging walls and enclosing a plurality of superposed arrays of heating pipes, each array having a separate intake conduit and a separate discharge conduit for the heating medium; said means for imparting a turbulent flow to the coal including a plurality of horizontally oriented pipes arranged side-by-side and provided with an intake port for a pressure medium and with a plurality of discharge openings for the pressure medium which imparts the turbulent movements to the coal; and said horizontally oriented pipes including upwardly directed end portions extending along the inner wall of the assigned container, said upwardly directed portions being provided with discharge openings.

2. A device as defined in claim 1, wherein said discharge openings are formed at the bottom side of respective horizontal pipes.

* * * * *